United States Patent [19]

Hlinka

[11] Patent Number: 4,801,056

[45] Date of Patent: Jan. 31, 1989

[54] DISTRIBUTOR FOR CONTINUOUS CASTING MACHINE

[75] Inventor: Joseph W. Hlinka, Bethlehem, Pa.

[73] Assignee: Bethlehem Steel Corp., Bethlehem, Pa.

[21] Appl. No.: 59,715

[22] Filed: Jun. 8, 1987

[51] Int. Cl.[4] ..... B22D 11/10

[52] U.S. Cl. ..... 222/594; 164/437

[58] Field of Search ..... 164/437, 439, 440, 335, 164/337; 222/594, 606, 607

[56] References Cited

U.S. PATENT DOCUMENTS

| | | | |
|---|---|---|---|
| Re. 21,260 | 4/1939 | Hazelett | 22/57.2 |
| 1,611,911 | 11/1926 | Hazelett | 22/57.2 |
| 1,831,623 | 11/1931 | Drake | 164/337 X |
| 2,225,373 | 1/1940 | Goss | 22/57.2 |
| 2,793,410 | 10/1957 | Junghans et al. | 22/57.2 |
| 3,281,903 | 11/1966 | Ross | 164/440 X |
| 3,467,284 | 7/1969 | Koncsics et al. | 222/166 |

FOREIGN PATENT DOCUMENTS

| | | | |
|---|---|---|---|
| 61-7050 | 9/1986 | Japan . | |
| 647435 | 1/1985 | Switzerland | 164/335 |
| 1148695 | 4/1985 | U.S.S.R. | 222/594 |

OTHER PUBLICATIONS

"Baffle for pour pot of continuous copper rod casting system" by Louzon, Western Electric Technical Digest, No. 46, 4/77 p. 25.

*Primary Examiner*—Kuang Y. Lin

*Attorney, Agent, or Firm*—John I. Iverson

[57] ABSTRACT

A distributor for introducing molten metal into a continuous casting machine. The molten metal is allowed to flow through two interconnected compartments before it is introduced into the continuous casting machine.

8 Claims, 2 Drawing Sheets

DISTRIBUTOR FOR CONTINUOUS CASTING MACHINE

BACKGROUND OF THE INVENTION

This invention relates to apparatus for the continuous casting of metals and more particularly to a distributor for introducing molten metal into a continuous casting machine. It is especially suitable for use with continuous casting machines that use either opposed rolls or endless belts as continuous moving mold surfaces.

It has long been recognized in the art of continuously casting molten metals that in order to cast a quality, uniform product, the molten metal should be introduced into the continuous casting machine at a uniform rate and without turbulence. Previous distributors have used stopper rods, gate valves, float valves, pumps, siphons, tubes and other devices in an attempt to control the flow of molten metal into the continuous casting machine. In practice, the flow rates in such devices varied during the casting operation due to clogging, wear or being subject to a varying head of metal in the distributor. Furthermore, many of the known distributors are only suitable for narrow molds and cannot distribute the metal uniformly across the full width of a wide sheet or slab mold.

A number of the known distributors depend on the alertness and skill of the operator to maintain a uniform flow rate.

Many of the known distributors make no provision for treating or otherwise conditioning the molten metal prior to its introduction into the continuous casting machine.

SUMMARY OF THE INVENTION

It is therefore an object of this invention to provide a distributor for introducing molten metal into a continuous casting machine whereby the velocity, rate and distribution pattern of the molten metal entering the continuous casting mold can be accurately controlled.

It is a further object of this invention to provide a distributor which does not rely on the alertness and skill of the operator, permits the treating or conditioning of the molten metal immediately prior to its introduction into the continuous casting machine and provides a precise, positive control of the molten metal stream.

Other and further objects of this invention will become apparent from the following description and the accompanying drawings and claims.

It has been discovered that the foregoing object can be attained by a distributor having a refractory upper chamber and a refractory lower chamber having a downwardly sloping sidewall surface and a plate member separating the two chambers. The plate member has at least one molten metal passage extending between the upper chamber and the lower chamber. The outlet of the molten metal passage is oriented so that it directs the molten metal against the downwardly sloping sidewall surface of the lower chamber and causes the molten metal to spread across substantially the full width of the wall before it is collected in the lower chamber and then flows either vertically or horizontally into the continuous casting machine.

DESCRIPTION OF THE PREFERRED EMBODIMENTS

Figure 1:
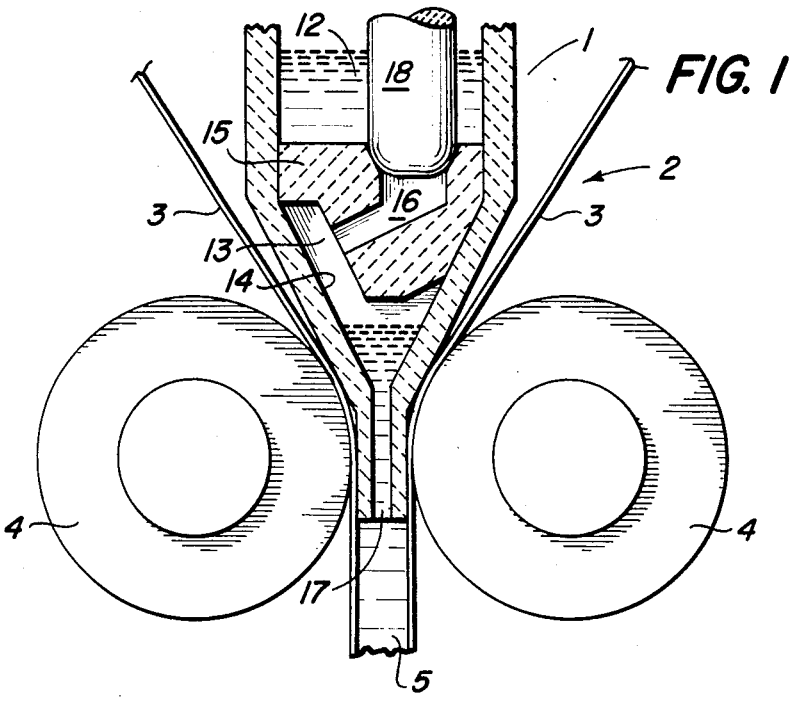
FIG. 1 is a vertical section of one embodiment of this invention for introducing molten metal vertically between a pair of endless belts used as the mold of the continuous casting machine.

Referring to the FIGURES and especially FIG. 1, the distributor 1 of this invention is shown in conjunction with a vertical continuous casting machine 2 in which molten metal from the distributor 1 is introduced vertically between a pair of moving, endless, watercooled belts 3 which are supported and driven by rollers 4 to cast the molten metal as a thin wide slab 5.

Figure 2:
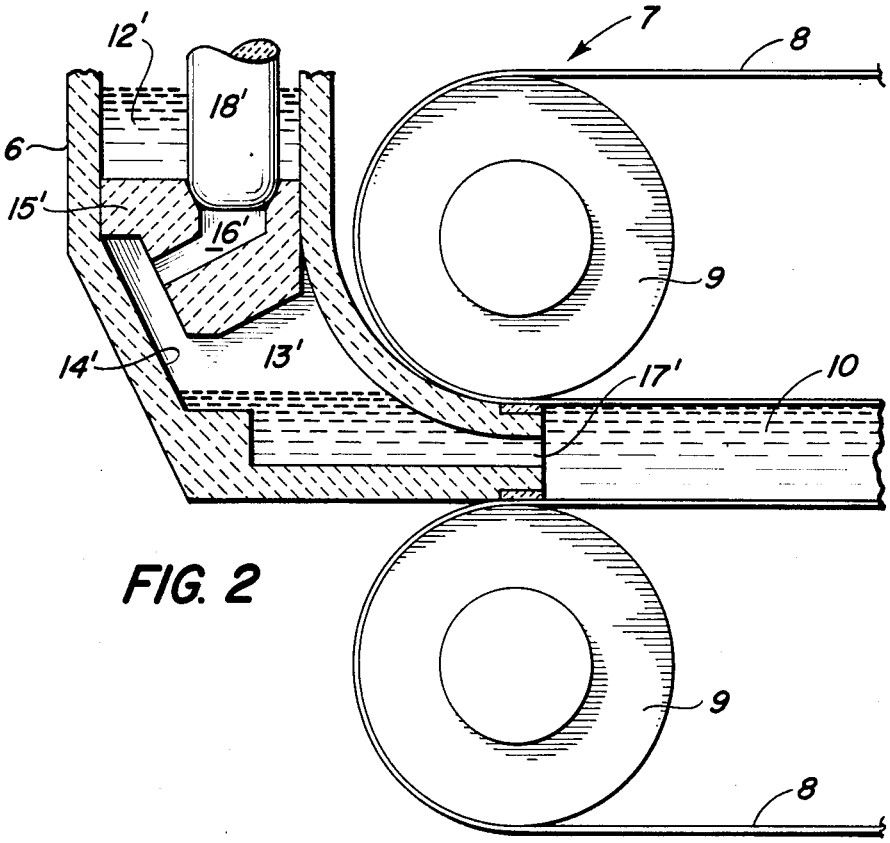
FIG. 2 is a vertical section of a second embodiment of this invention for introducing molten metal horizontally between a pair of endless belts used as the mold of the continuous casting machine.

FIG. 2 illustrates a second embodiment showing a distributor 6 of this invention in conjunction with a horizontal continuous casting machine 7 in which molten metal from the distributor 6 is introduced horizontally in between a pair of moving, endless, watercooled belts 8 which are supported and driven by rollers 9 to cast the metal as a thin wide slab 10.

Endless belt casting machines of the type illustrated by these two embodiments are described in U.S. Pat. No. 3,036,348 to Hazelett, et al.

Figure 3:
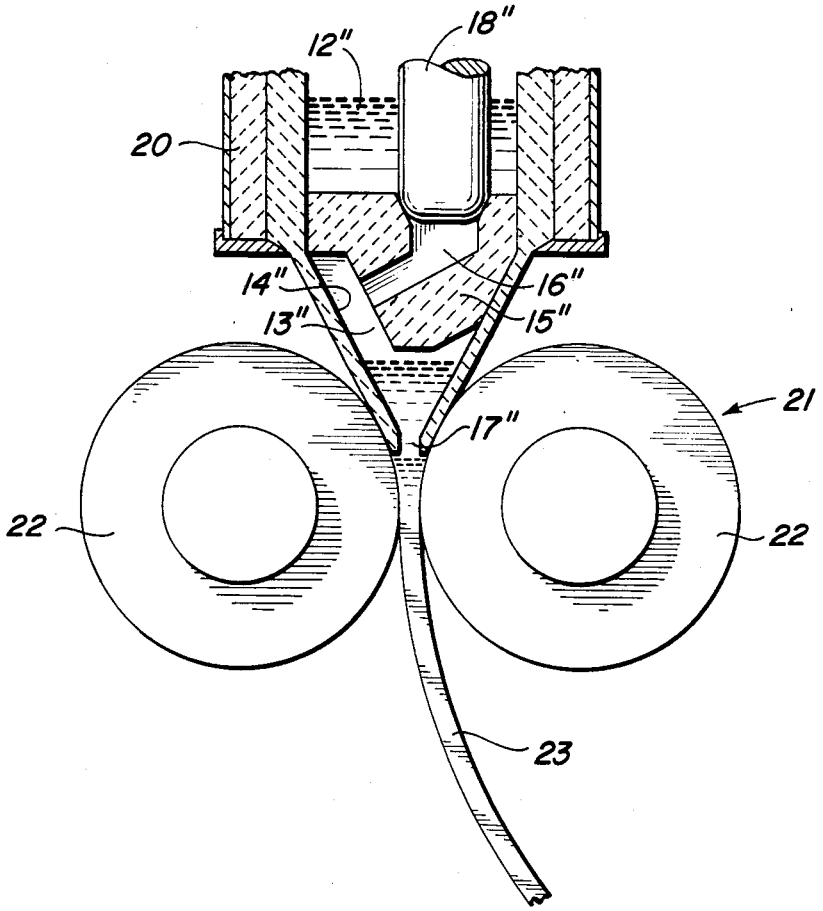
FIG. 3 is a vertical section of a third embodiment of this invention for introducing molten metal vertically between a pair of watercooled rolls used as the mold of the continuous casting machine.

FIG. 3 illustrates a third embodiment showing a distributor 20 of this invention in conjunction with a vertical continuous casting machine 21 in which the molten metal from the distributor 20 is introduced vertically between a pair of opposed, closely spaced watercooled rolls 22 to cast the metal as a thin sheet 23.

It is understood that this distributor is not limited to use with endless belt casting or opposed watercooled rolls casting machines but could be adapted for use with most other types of casting machines such as those using rotating wheels and belts or those using an open-ended watercooled mold.

Referring again to FIGS. 1, 2 and 3 the distributors 1, 6 and 20 are comprised of a refractory upper chamber 12, 12' and 12'' and a refractory lower chamber 13, 13' and 13''. The lower chamber 13, 13' and 13'' has at least one downwardly sloping sidewall surface 14, 14' and 14''. The angle of this sloping sidewall surface is preferably between 45 and 80 degrees from the horizontal. A refractory plate member 15, 15' and 15'' separates the upper chamber 12, 12' and 12'' from the lower chamber 13, 13' and 13''. The refractory plate member 15, 15' and 15'' has one or more molten metal passages 16, 16' and 16'' extending between the upper chamber 12, 12' and 12'' and the lower chamber 13, 13' and 13''.

The outlet 17, 17' and 17'' of the molten metal passage 16, 16' and 16'' is oriented so that it directs the molten metal substantially normal to the downwardly sloping wall surface 14, 14' and 14'' of the lower chamber 13, 13' and 13''. This orientation causes the molten metal to strike the sloping wall surface 14, 14' and 14'' in such a manner that it spreads across substantially the full width of the bottom chamber before being collected in a pool at the bottom of the lower chamber 13, 13' and 13''. The energy in the molten metal flowing from the upper chamber 12, 12' and 12'' to the lower chamber 13, 13' and 13'' is dispersed in spreading the molten metal across the width of the sloping wall surface 14, 14' and 14″ so that the molten metal collected in the lower chamber is quiescent and easily introduced through nozzles 17, 17′ and 17″ into the respective continuous casting machines.

The molten metal is introduced into the upper chamber 12, 12′ and 12″ from a ladle or tundish by a submerged nozzle or as an open stream (not shown) The upper chamber 12, 12′ and 12″ is preferably maintained at atmospheric pressure but to prevent oxidation the molten metal surface in the upper chamber 12, 12′ and 12″ is preferably covered with a protective slag layer or shielded by a nonoxidizing gas or both. A refractory stopper rod 18, 18′ and 18″ or other valve means at the top of the molten metal passage 16, 16′ and 16″ controls the rate at which the molten metal is allowed to pass from the upper chamber 12, 12′ and 12″ to the lower chamber 13, 13′ and 13″.

The lower chamber 13, 13′ and 13″ being closed and sealed by the molten metal permits one to maintain the chamber at less than or more than atmospheric pressure to further process the molten metal or to maintain a protective nonoxidizing atmosphere over the surface of the molten metal to prevent contamination with oxides prior to casting. Such pressurization can be used to control upstream pressure and flow rate to the mold.

The exact shape and size of the distributor of this invention will be determined by the size and configuration of the casting machine associated with it.

I claim:

1. Distributor apparatus for receiving molten metal from a ladle or tundish and for introducing the molten metal into a continuous casting machine comprising a unitary refractory upper chamber and refractory lower chamber, said lower chamber having at least one downwardly sloping sidewall surface, a plate member forming the bottom of said upper chamber and the top of said lower chamber and having at least one molten metal passage in said plate member extending between said upper chamber and said lower chamber, the outlet of said passage being oriented so that it directs the molten metal against the downwardly sloping wall surface above the level of the pool of molten metal in said lower chamber whereby the molten metal discharged from said passage is spread across substantially the full width of said downwardly sloping wall surface before being collected in a pool of molten metal in said lower chamber.

2. The apparatus of claim 1 in which the lower chamber has a vertical nozzle for introducing the molten metal vertically into a continuous casting machine.

3. The apparatus of claim 1 in which the lower chamber has a horizontal nozzle for introducing the molten metal horizontally into a continuous casting machine.

4. The apparatus of claim 1 in which the molten metal passage is equipped with valve means to control the flow of molten metal through the passage.

5. The apparatus of claim 1 in which the upper chamber is maintained at atmospheric pressure and the lower chamber is maintained at less than or greater than atmospheric pressure.

6. The apparatus of claim 1 in which the lower chamber contains a nonreactive gas.

7. The apparatus of claim 1 in which the surface of the molten metal contained in the upper chamber is covered with a protective slag material.

8. The apparatus of claim 1 in which the sidewall surface of the lower chamber slopes downwardly at an angle between 45 and 80 degrees from the horizontal.

* * * * *